US007677546B2

(12) United States Patent
Saltsov et al.

(10) Patent No.: US 7,677,546 B2
(45) Date of Patent: Mar. 16, 2010

(54) VALIDATOR WITH RECYCLING CASSETTE AND STACKER

(75) Inventors: Leon Saltsov, Thornhill (CA); Sergiy Androsyuk, Toronto (CA); Oleksandr Onipchenko, Thornhill (CA); Dmitro Baydin, Toronto (CA); Oleksandr Lukonin, Thornhill (CA); Sergiy Bukhman, Toronto (CA)

(73) Assignee: Crane Canada Co., Concord, ON (CA)

( * ) Notice: Subject to any disclaimer, the term of this patent is extended or adjusted under 35 U.S.C. 154(b) by 390 days.

(21) Appl. No.: 11/201,191

(22) Filed: Aug. 11, 2005

(65) Prior Publication Data

US 2006/0214350 A1 Sep. 28, 2006

(30) Foreign Application Priority Data

Mar. 24, 2005 (CA) ..... 2502344

(51) Int. Cl.
*B65H 5/22* (2006.01)
*G07F 7/04* (2006.01)

(52) U.S. Cl. ..... 271/3.14; 271/3.01; 194/206

(58) Field of Classification Search ..... 271/3.14, 271/3.01, 176, 177, 180, 181, 902, 301, 314
See application file for complete search history.

(56) References Cited

U.S. PATENT DOCUMENTS

| | | | | |
|---|---|---|---|---|
| 4,510,380 | A | 4/1985 | Uchida et al. | |
| 4,554,444 | A | 11/1985 | Hirose | |
| 4,596,924 | A | 6/1986 | Watanabe | |
| 4,639,582 | A | 1/1987 | Arikawa et al. | |
| 5,173,590 | A | 12/1992 | Nakano et al. | |
| 5,186,334 | A | 2/1993 | Fukudome et al. | |
| 5,540,544 | A | 7/1996 | Sacerdoti et al. | |
| 5,641,157 | A * | 6/1997 | Mays et al. | 271/181 |
| 6,006,989 | A | 12/1999 | Ademmer et al. | |
| 6,371,473 | B1 * | 4/2002 | Saltsov et al. | 271/3.01 |
| 6,663,001 | B2 | 12/2003 | Suttie et al. | |
| 6,712,219 | B2 | 3/2004 | Kobayashi et al. | |
| 6,712,352 | B2 * | 3/2004 | Bergeron et al. | 271/180 |
| 6,824,047 | B2 | 11/2004 | Katou et al. | |
| 6,860,480 | B2 * | 3/2005 | Saltsov et al. | 271/3.14 |
| 7,147,220 | B2 * | 12/2006 | Takeuchi | 271/177 |
| 7,252,284 | B2 * | 8/2007 | Takeuchi | 271/181 |
| 7,464,921 | B2 * | 12/2008 | Katou et al. | 271/3.14 |
| 2003/0107166 | A1 * | 6/2003 | Cost et al. | 271/177 |
| 2004/0016798 | A1 * | 1/2004 | Saltsov et al. | 235/379 |
| 2004/0217536 | A1 * | 11/2004 | Isobe et al. | 271/3.14 |

FOREIGN PATENT DOCUMENTS

| | | | |
|---|---|---|---|
| CA | 2299827 | | 2/2001 |
| CA | 2339722 | | 2/2001 |
| EP | 1510978 | | 2/2005 |
| EP | 1510978 | A1 * | 3/2005 |
| JP | 59064469 | * | 4/1984 |

* cited by examiner

*Primary Examiner*—Patrick H Mackey
*Assistant Examiner*—Patrick Cicchino

(57) ABSTRACT

A banknote acceptor and dispenser uses a stacked configuration of the validator the banknote accumulator and dispenser and the banknote cassette. The banknote path is relatively short to avoid bill misalignment by providing the banknote accumulator and dispenser in the intermediary position.

13 Claims, 11 Drawing Sheets

VALIDATOR WITH RECYCLING CASSETTE AND STACKER

FIELD OF THE INVENTION

The present invention relates to banknote acceptors and dispensers, and in particular, to such a device for use in association with standalone vending machines.

BACKGROUND OF THE INVENTION

Automated cashiers for use in association with stores are becoming more common where these devices include a banknote acceptor and dispenser for receiving cash from the customer and providing him with the appropriate change for a transaction. Some of these devices include a supply of depleting banknotes which are provided to the arrangement from time to time by an operator for dispensing of change. In other systems, the arrangement includes a banknote accumulator where banknotes provided for payment by the customer can be temporarily stored in the accumulator for later dispensing as change. These types of arrangements can reduce the frequency of service required to replenish banknotes and/or increase the transaction capabilities of the system.

It is a common practice in the vending industry to include a coin dispensing arrangement. It is also known with respect to vending machines to provide an arrangement where coins inserted by a customer are accumulated by the device for dispensing as change for a subsequent transaction.

Vending machines are now used for the sale of more expensive product and banknote validators are now commonly associated with vending machines. With these higher prices, the need to improve the performance by dispensing of banknotes as change has increased.

The present invention provides a compact banknote acceptor and dispenser which includes a banknote accumulator as well as a banknote cassette. The efficient space utilization renders the system suitable for many existing vending machines. Many of the vending machines have restricted space available for the banknote validating arrangement and the present design effectively utilizes the space on an efficient manner.

SUMMARY OF THE INVENTION

A banknote acceptor and dispenser according to the present invention comprises a banknote validator for receiving and validating banknotes, a banknote accumulator and dispenser for temporarily receiving banknotes for dispensing as change for subsequent transactions and a removable banknote cassette. The banknote accumulator and dispenser is located between the banknote validator and the removable banknote cassette. This particular position provides an efficient arrangement for receiving and storing of banknotes and also maintains a relatively short banknote path for providing the banknote to either the banknote accumulator and dispenser or the removable banknote cassette.

According to an aspect of the invention, the banknote acceptor and dispenser includes a structural frame that secures the banknote validator and releasably receives the banknote accumulator and the removable banknote cassette.

In yet a further aspect of the invention, the banknote acceptor and dispenser includes a reversible banknote drive path which extends between the banknote validator and a first portion of the removable banknote cassette.

In yet a further aspect of the invention, the banknote acceptor and dispenser has the reversible banknote path partially defined by an exterior surface of the banknote accumulator and dispenser.

According to a further aspect of the invention, the banknote drive path includes an angled transition adjacent the banknote validator and the banknote accumulator and dispenser with this angled transition joining with an offset region to one side of the accumulator. The banknote drive path further includes an additional angled transition joining the offset region and a banknote feed position of the removable banknote cassette.

In yet a further aspect of the invention, the banknote accumulator has a back face aligned with a back face of the removable cassette.

In yet a further aspect of the invention, the banknote accumulator and dispenser is capable of storing at least 20 banknotes.

In yet a further aspect of the invention, the banknote accumulator and dispenser partially defines the reversible banknote drive path on an exterior surface thereof and the exterior surface includes components of a banknote sensor arrangement.

In yet a further aspect of the invention, the components of the banknote sensing arrangement includes at least two light prisms at spaced positions along the banknote drive path.

In a further aspect of the invention, the reversible banknote drive path includes drive rollers secured in a structural frame that secures the banknote validator and releasably receives the banknote accumulator and the removable banknote cassette. The banknote accumulator and dispenser includes idler rollers in an exterior surface thereof that cooperate with the drive rollers for moving banknotes along the banknote drive path.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
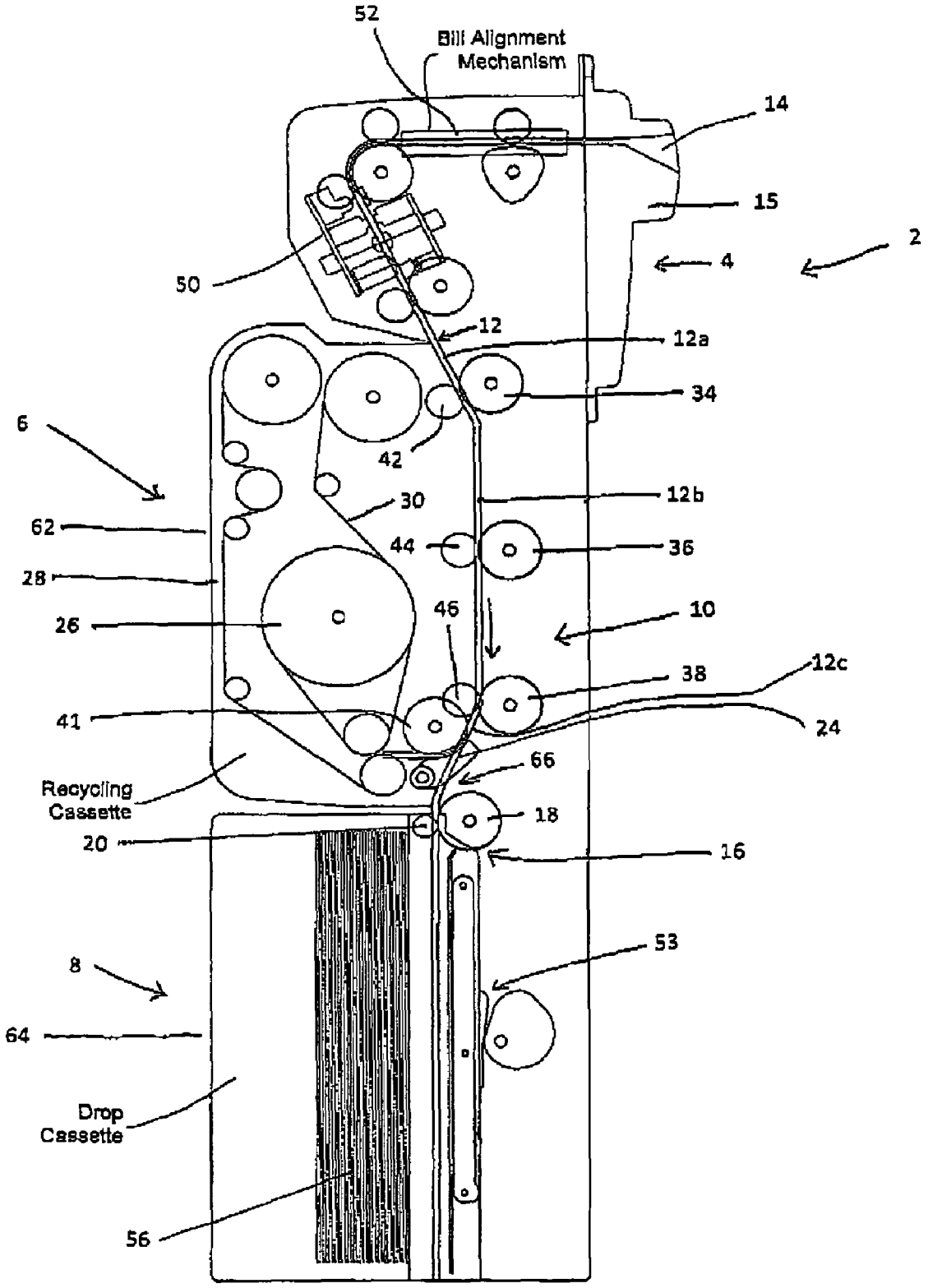
FIG. 1 is a vertical sectional view showing the banknote acceptor and dispenser.

The banknote acceptor and dispenser 2 includes the banknote validator 4 an intermediary banknote accumulator and dispenser 6, and a removable banknote cassette 8. These components are held in the structural frame 10. The banknote validator, the banknote accumulator and dispenser and the removable banknote cassette are in an aligned stacked arrangement to reduce the depth of the banknote acceptor and dispenser. The banknote accumulator and dispenser, as well as the removable banknote cassette are releasably held in the structural frame 10.

The banknote acceptor and dispenser 2 includes the reversible banknote path 12 which connects the banknote inlet/outlet 14 associated with the bezel 15 and directs a banknote to the banknote accumulator and dispenser 6 or the banknote cassette 8 as determined by the device if the banknote is accepted. Basically, the banknote validator accepts or rejects banknotes based on an evaluation carried out in the validator using the sensors 50. If the banknote is accepted, it will be moved along the banknote path 12 and directed by banknote gate 24 to the banknote accumulator and dispenser 6, if the gate is in the position of FIG. 1, or the banknote will be directed to the banknote cassette 8 if the gate is in the position shown in FIG. 2. The roller drive arrangement operates in a consistent manner and it is the banknote gate 24 that determines the final destination of a received banknote.

The banknote validator includes a processor and computing arrangement for determining whether a banknote will be accumulated for later dispensing or merely stored in the banknote cassette. Typically, the software is based on a single denomination of banknote being accumulated by a banknote accumulator and dispenser. If a received banknote is of sufficient quality and of the correct denomination, it will typically be accumulated by the accumulator and dispenser 6 unless this device is at a maximum capacity. Typically, the capacity of the banknote accumulator is at least 20 banknotes and it is preferably 30 banknotes or more. The limitation on the number of banknotes to be stored is basically a space requirement and it is desired that the back face 62 of the accumulator is approximately in line with or slightly inwardly of the back face 64 of the banknote cassette 8. To allow for additional banknotes to be accumulated in device 6, the banknote path 12 includes an angled transition 12*a* which connects to the inwardly offset portion 12*b* associated with the accumulator 6 and a further angled transition portion 12*c* for connecting with the inlet 66 of the banknote cassette 8. The angled transition 12*c* provides a banknote to the drive roller 18 and idler roller 20 at the first portion of the removable banknote cassette 8. The offsetting of the banknote path at 12*b* allows for additional room within a central portion of the banknote accumulator and dispenser 6. In this way, additional banknotes can be stored on the banknote accumulating drum 26. The angled transition portion 12*c* connects to the normal slightly offset inlet of a banknote cassette. A banknote pusher arrangement 53 is provided to one side of the banknote cassette.

When a banknote is fed to the banknote accumulator and dispenser via the gate 24, the banknote is wound around the drum 26 and includes opposed separating tapes 28 and 30 either side of the banknote. In this way, banknotes are wound on the drum 26 in a sequential manner and are unwound from the drum in a sequential manner and returned to the banknote path 12.

The banknote path 12 moves a received banknote through the banknote centering mechanism 52 provided in the banknote validator 4. It subsequently moves the banknote past the sensors 50. The validator then determines whether the banknote is valid and whether the valid banknote should be accumulated for later dispensing or merely provided to the banknote cassette 8. The validator controls the position of the banknote gate 24. The validator also controls the drive mechanism for the banknote accumulator and dispenser 6. It will only operate this mechanism when a banknote is to be received or when a received banknote in the accumulator is to be dispensed and provided to the banknote path 12 and moved to the banknote inlet/outlet 14.

From FIG. 1 it can also be seen that the banknote path 12 basically terminates at the upper end of the banknote cassette 8. This provides a relatively short banknote path and a banknote provided to the first portion 16 of the cassette will continue down in a slot provided in the cassette for stacking in the cassette as indicated by the stack of banknotes 56.

Figure 2:
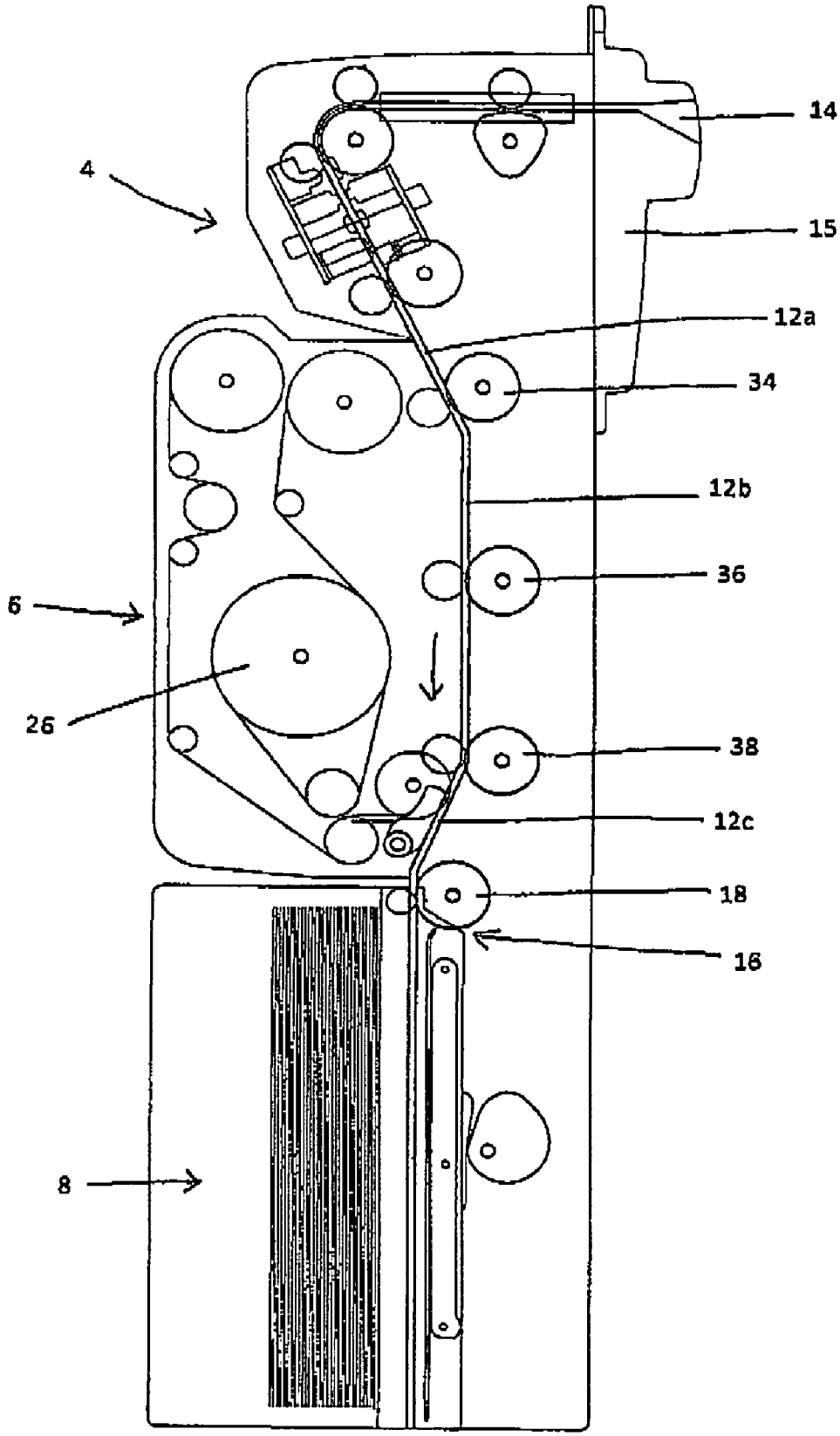
FIG. 2 is a vertical sectional view showing the banknote drive path in a position such that the banknote received by the validator will be provided to the banknote cassette.

FIG. 2 shows the banknote path connecting the inlet/outlet 14 with the banknote cassette.

Figure 3:
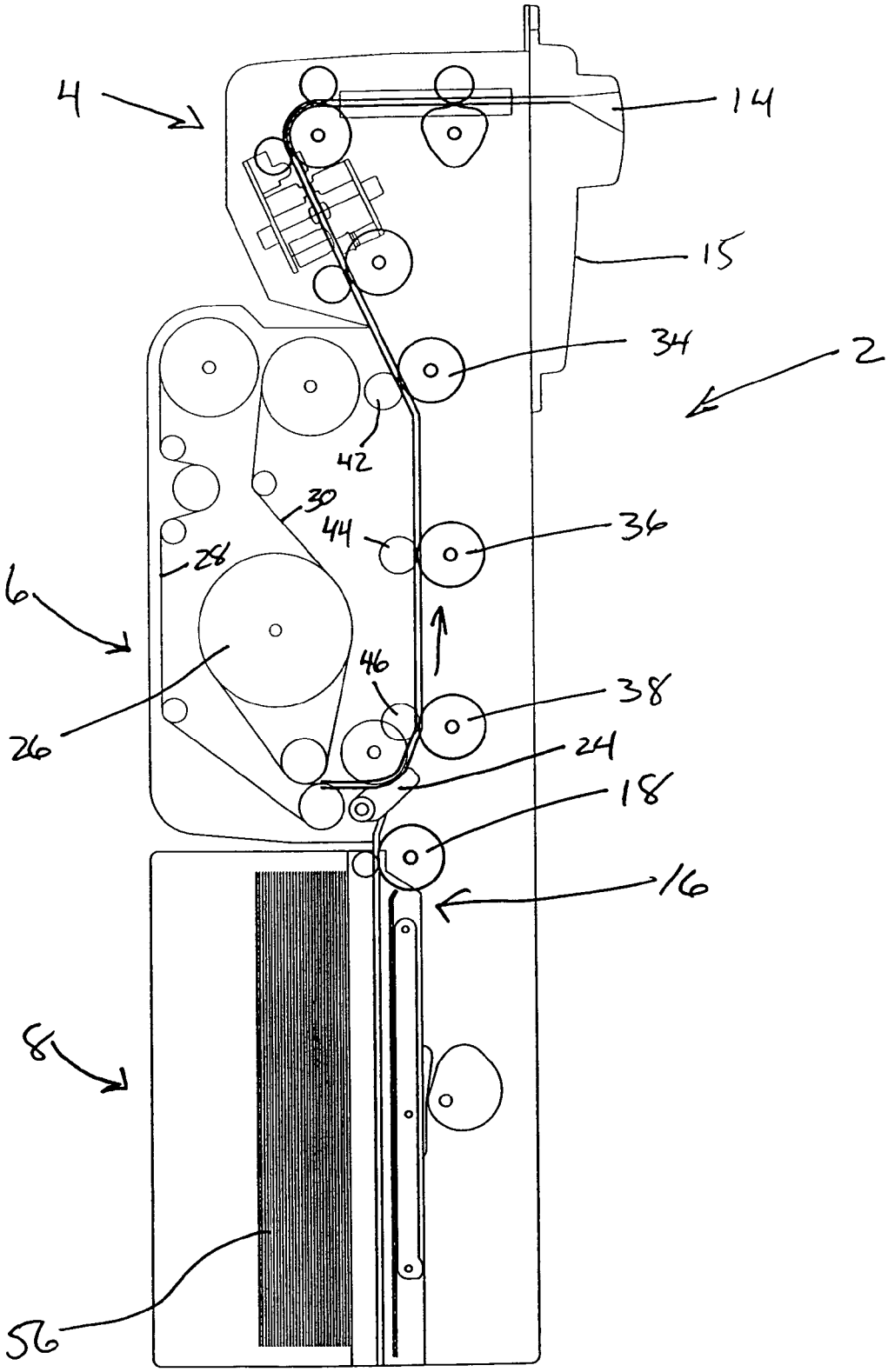
FIG. 3 is a vertical sectional view similar to FIGS. 1 and 2 with the banknote accumulator actuated to direct a banknote to the accumulator.

FIG. 3 shows the gate 24 in an operative position which allows a banknote stored within the accumulator 6 to be provided to the banknote path and provided as change at the inlet/outlet 14.

Figure 4:
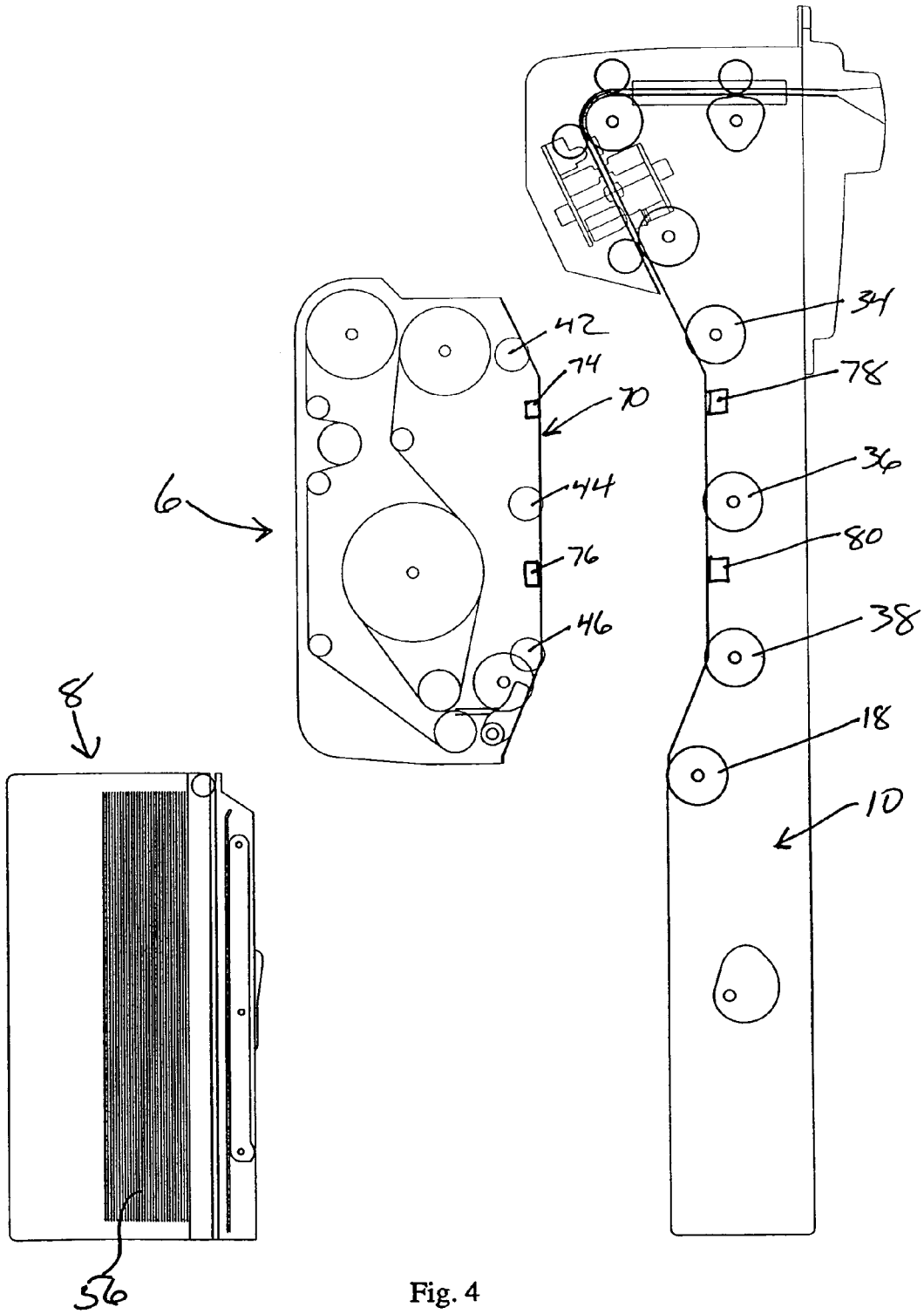
FIG. 4 is a vertical sectional view showing the banknote accumulator and dispenser in a release position and the removable banknote cassette in a release position.

In FIG. 4 the removable banknote cassette 8 has been separated from the structural frame 10 and also the banknote accumulator and dispenser 8 is also separated. As can be seen, the banknote path 12 is now open due to the removal of the banknote accumulator and dispenser 6. Part of the banknote path is defined along the exterior surface 70 of the banknote accumulator and dispenser 6. The active drive rollers 34, 36 and 38 are secured in the structural frame 10 as well as the drive roller 18 and these rollers are connected by a common drive arrangement. Drive rollers 34 and 38 are provided at a transition point associated with the angled transitions 12*a* and 12*c*. The exterior surface 70 of the accumulator 6 also includes projecting idler rolls 42, 44 and 46 which cooperate with the particular drive rollers.

Imbedded in the exterior surface 70 and exposed on the exterior thereof, are light prisms 74 and 76 a beam of light is emitted at the sensors 78 and 80 and the prisms 74 and 76 return the light to these sensors if a banknote is not present. Software logic is provided to determine whether a banknote has become jammed at a certain point in the banknote path or is passing a specific sensor.

Figure 5:
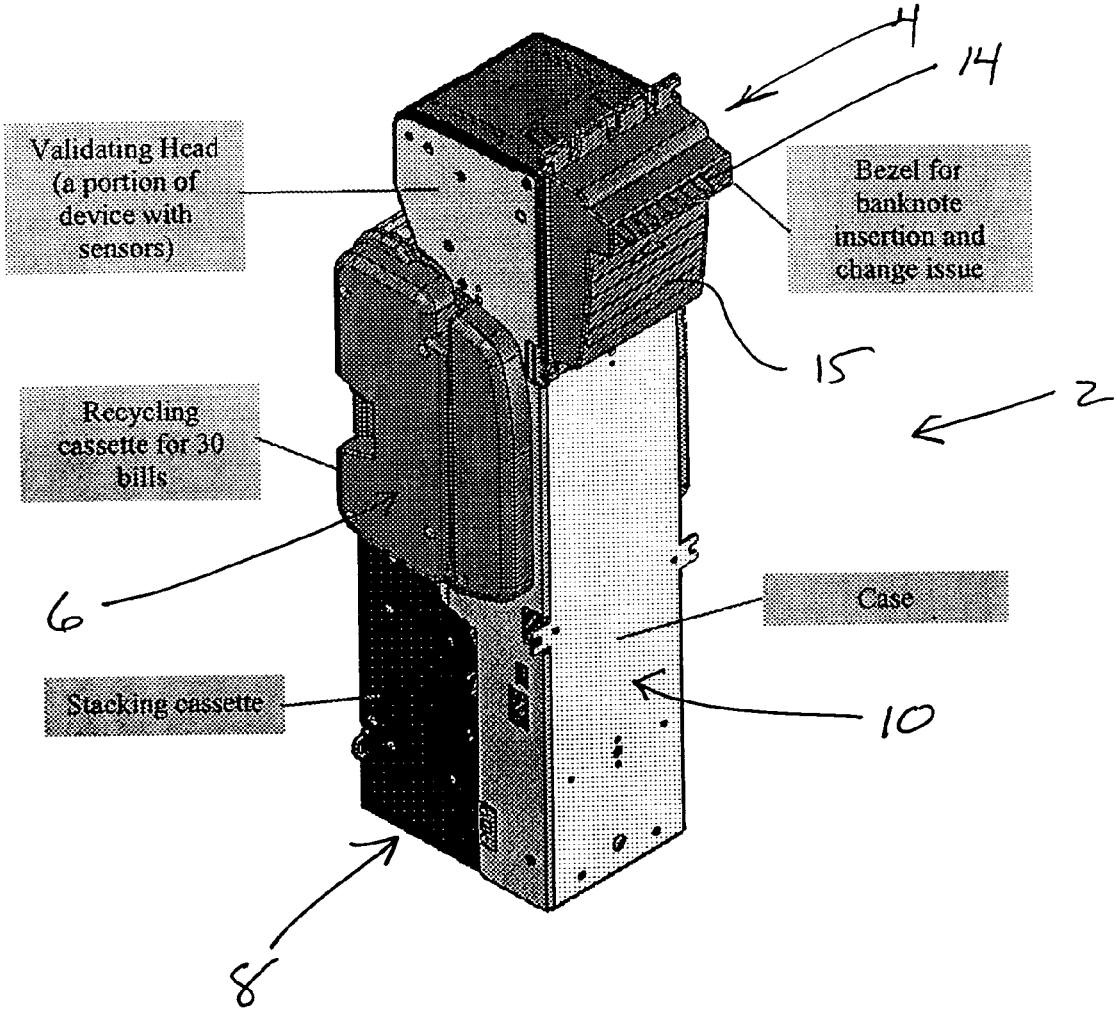
FIG. 5 is a front perspective view of the banknote accumulator and dispenser.
Figure 6:
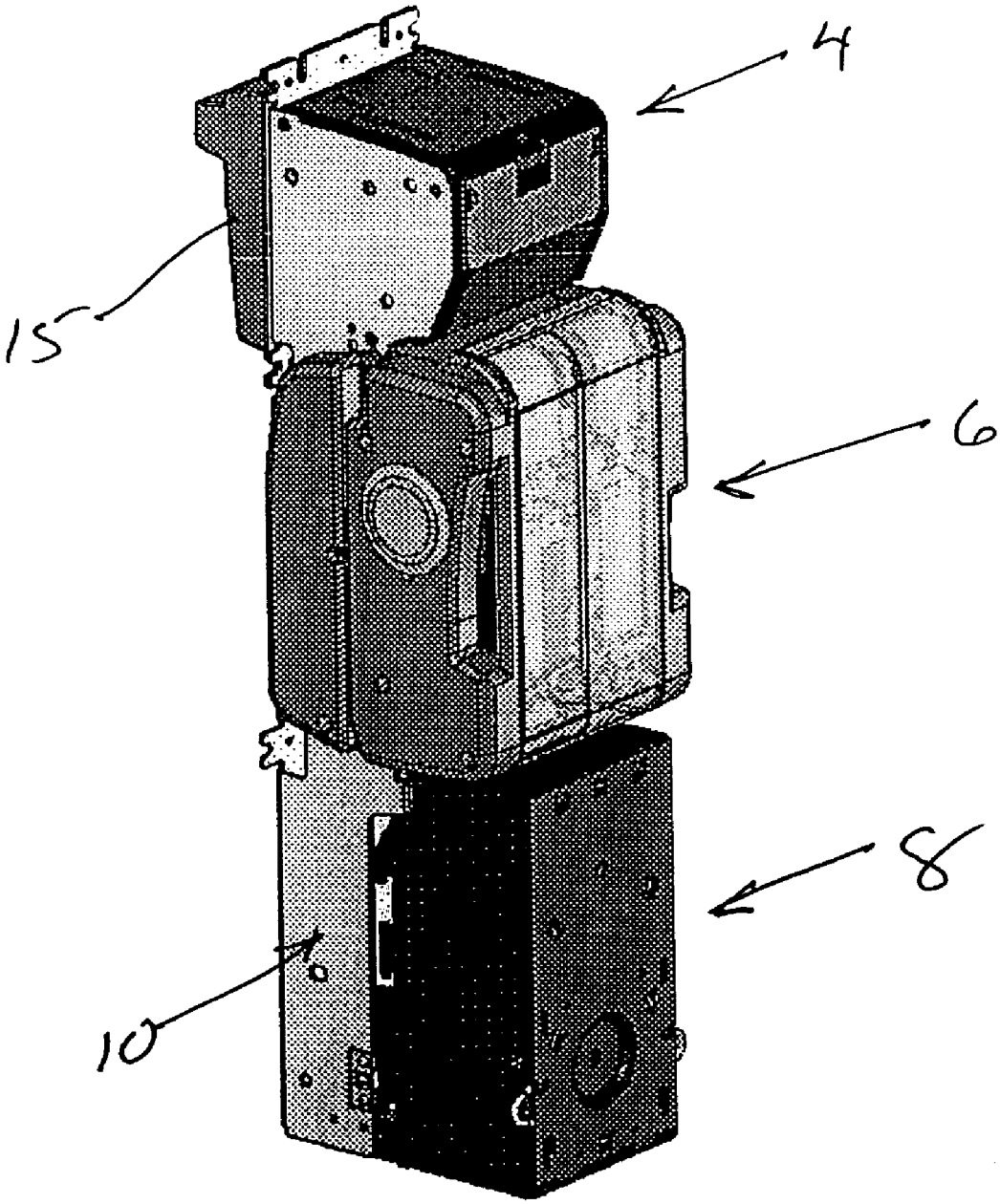
FIG. 6 is a rear perspective view of the banknote accumulator and dispenser.

FIGS. 5 and 6 shows the elongated stacked relationship of the validator head, the accumulator and the stacking banknote cassette.

Figure 7:
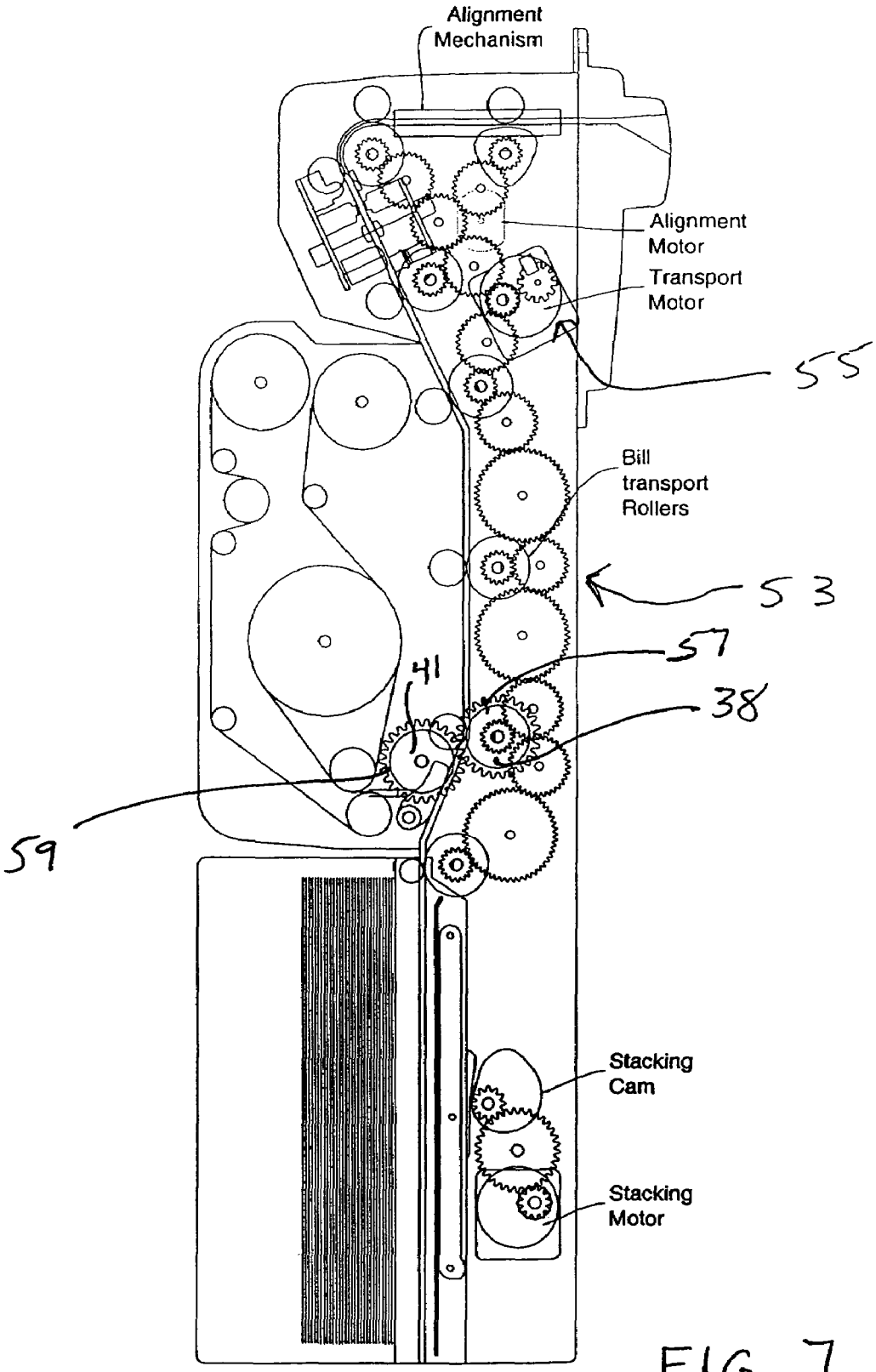
FIG. 7 is a vertical side view of the banknote accumulator and dispenser showing the drive trains.

FIGS. 6 and 7 also illustrate the cooperation between the banknote gate 24 drive roller 38 and drive roller 41 of the accumulator. Drive roller 41 partially protrudes into the banknote path 12 and assists in moving of a banknote to the cassette or to the accumulator. The gear train 53 drives the rollers with power provided by motor 55. Gear 57 is in mesh with gear 59. With this arrangement roller 41 is driven at the correct speed and the same speed as roller 38.

Figure 8:
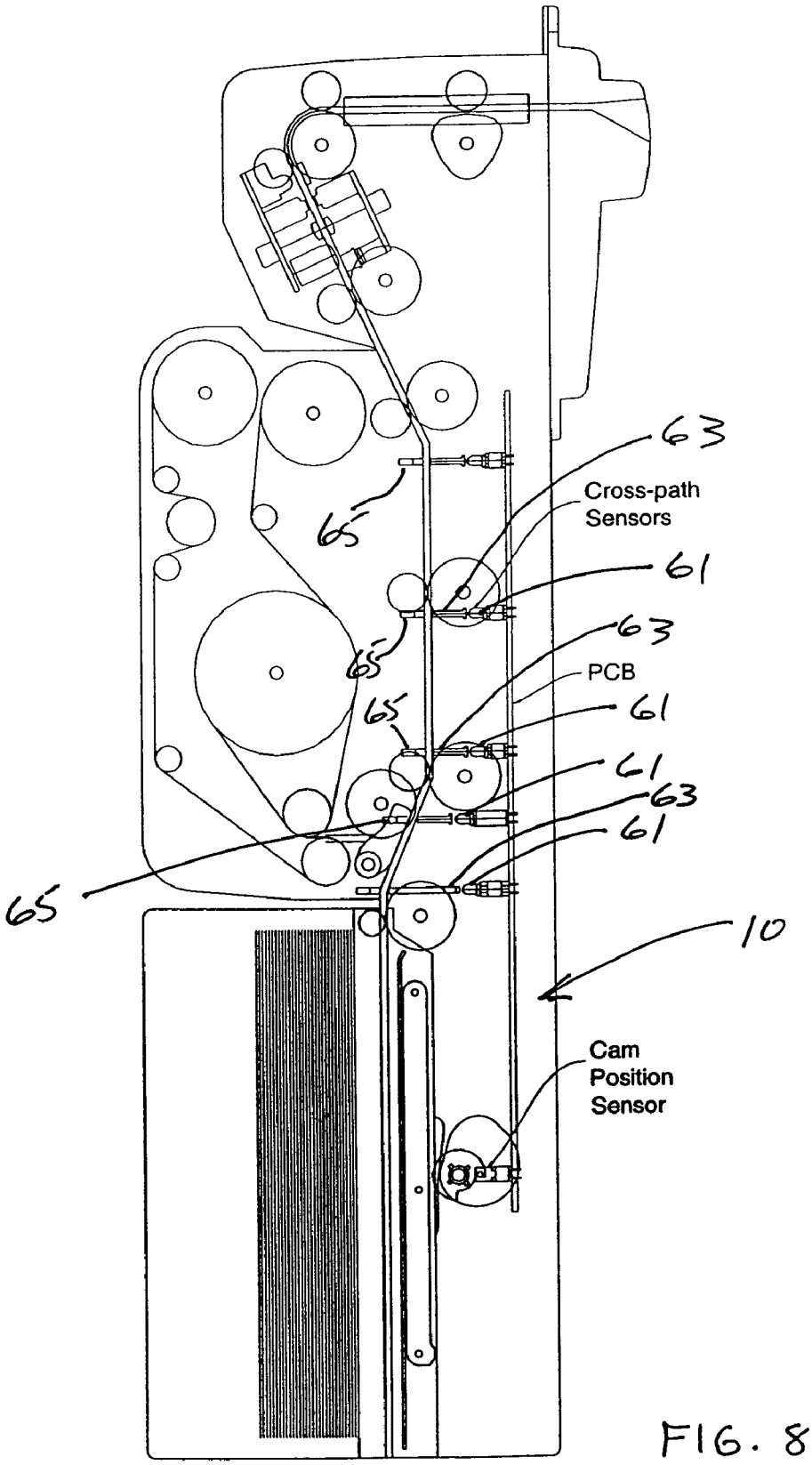
FIG. 8 is a vertical side view showing sensors secured on a PCB board.

FIG. 8 again takes advantage of the structural frame 10 to secure PCB board 10. PCB 10 includes a number of light emitters 61 and associated light guides 63 that project light across the banknote path 12. Light prisms 65 in the accumulator return the light to a receiver on the PCB board 10. If a banknote is present it interrupts the received light. With this arrangement the sensors remain with the frame and the removable accumulator has the less expensive components.

Figure 9:
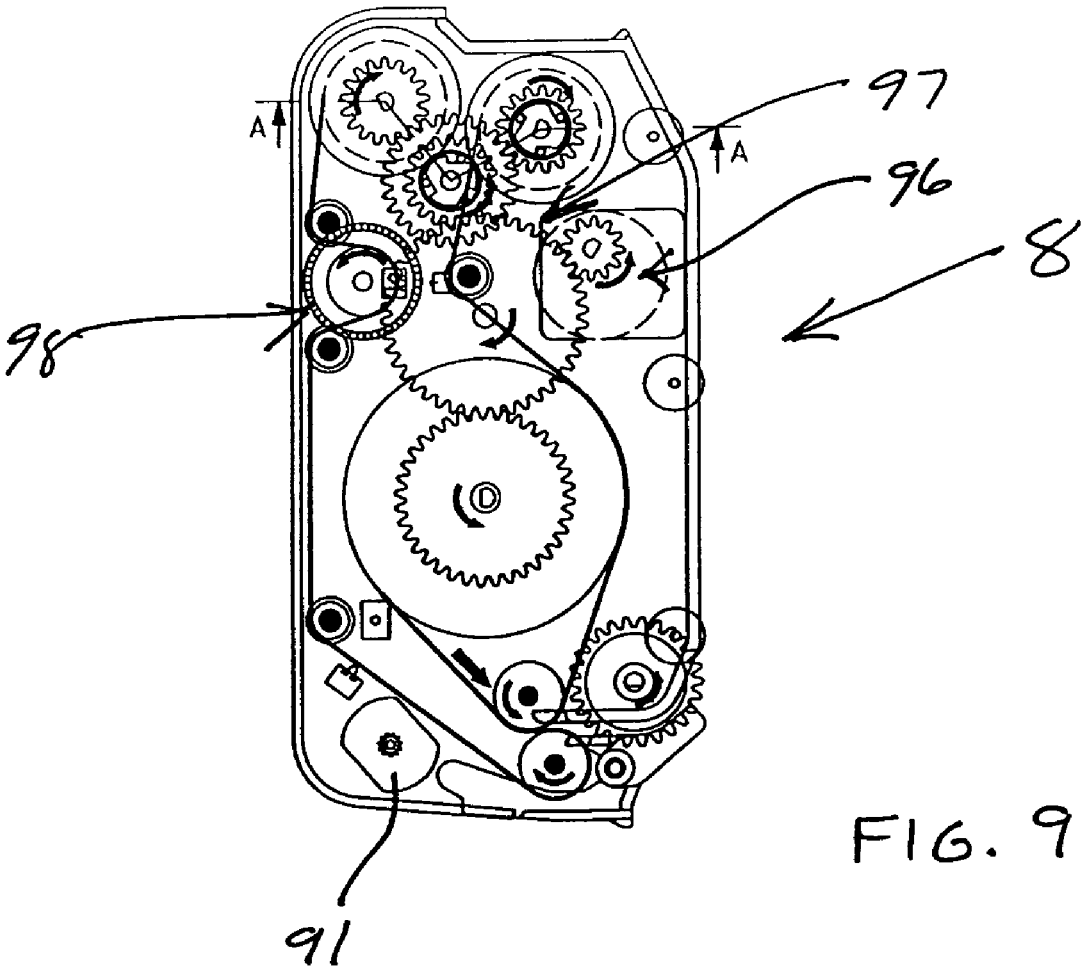
FIG. 9 shows the drive arrangement of the accumulator and dispenser.
Figure 10:
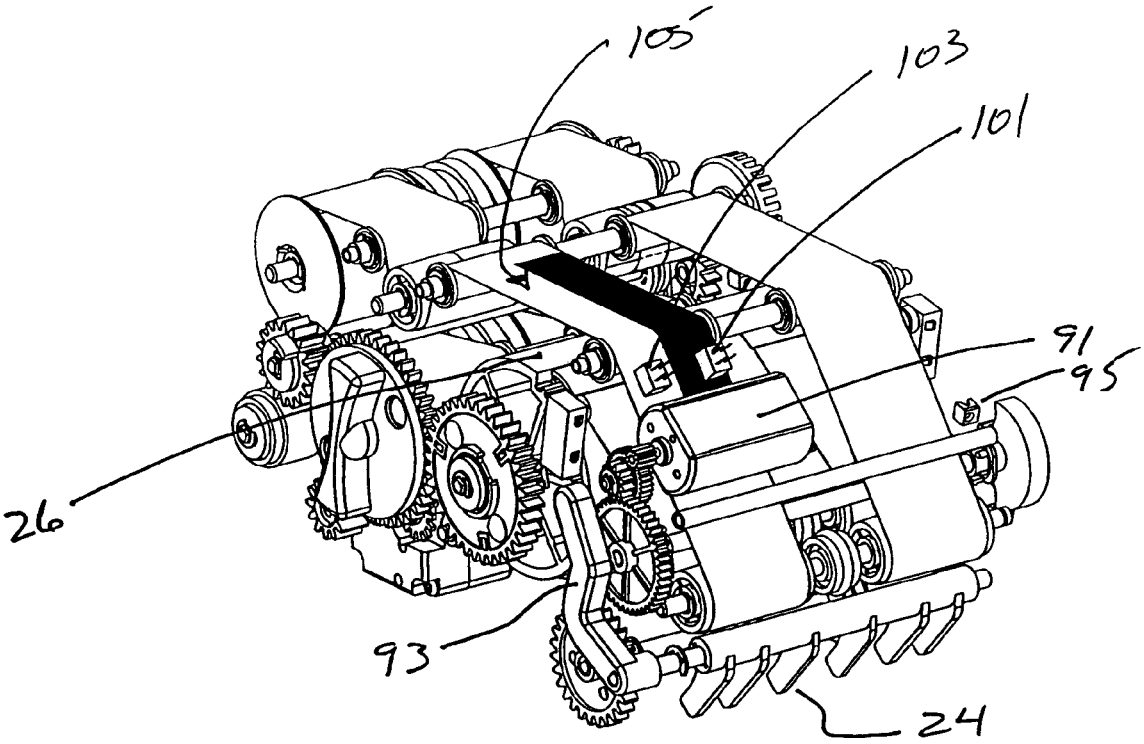
FIGS. 10 and 11 are perspective views of the working components of the accumulator and dispenser.
Figure 11:
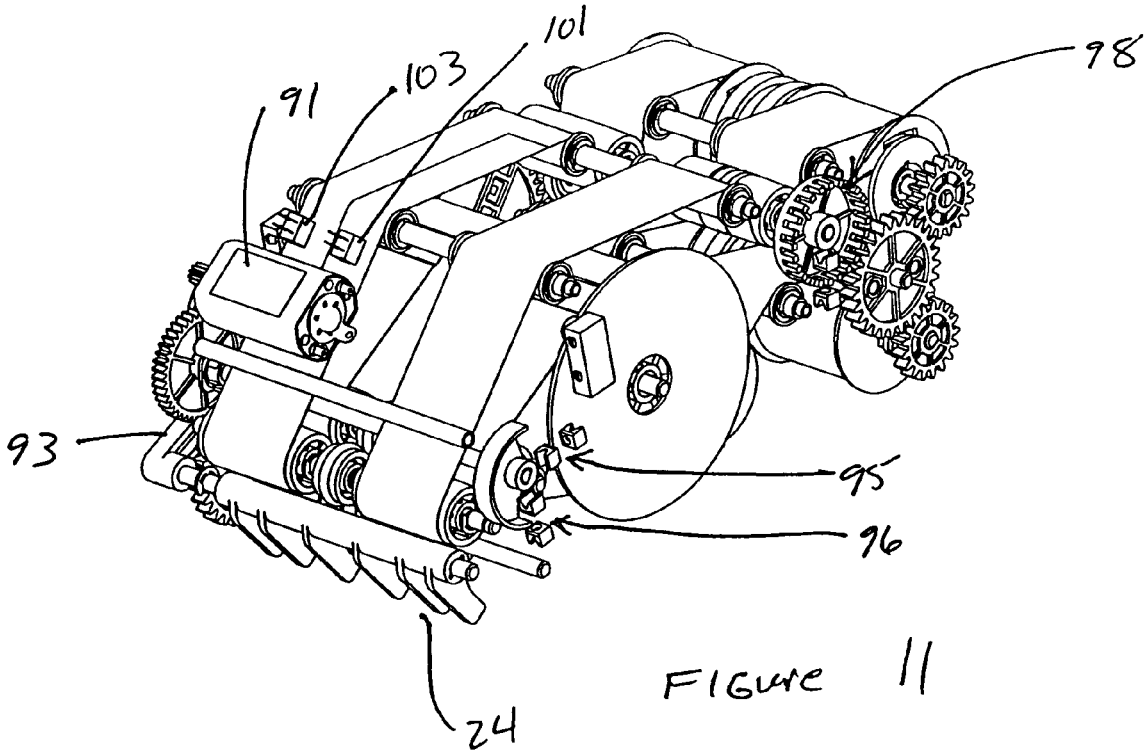

The accumulator 8 shown in FIGS. 9, 10 and 11 includes a motor 91 for controlling the banknote gate 24. A crank arm 93 moves the banknote gate as required. Sensors 95 and 96 determine the gate position.

The accumulator 8 includes its own drive motor, a gear train 97 and a tape speed sensor 98. This arrangement allows the speed of a banknote as it is received in the accumulator to be matched to a speed of the banknote in the banknote path during receipt and dispensing of a banknote.

Sensor 101 senses a beginning point of the tape 105 as one half of the tape is provided with a black strip. This indicates very little of tape 105 is wound on the accumulating drum 26. A black strip is provided on the opposite side and at the opposite end of tape 105 to indicate an end point of the tape. This second strip is sensed by the sensor 103.

Although various preferred embodiments of the present invention have been described herein in detail, it will be appreciated by those skilled in the art that variations may be made thereto without departing from the spirit of the invention or the scope of the appended claims.

The embodiments of the invention in which an exclusive property or privilege is claimed are defined as follows:

1. A banknote acceptor and dispenser comprising a banknote validator for receiving and validating banknotes;

a removable banknote accumulator and dispenser located at one side of said validator and adapted to temporarily receive banknotes for dispensing as change for subsequent transactions;

a removable banknote cassette located to a side of said banknote accumulator and dispenser opposite to said validator;

said removable banknote cassette and said removable banknote accumulator and dispenser with said validator being releasably maintained in a structural frame and forming a vertical stacked configuration with said banknote accumulator and dispenser located between said validator and said banknote cassette;

said banknote validator including a banknote slot on a front side of said banknote acceptor and dispenser for receiving banknotes to be validated;

said banknote acceptor and dispenser including a reversible banknote drive path extending through said validator and connecting said banknote slot and an inlet opening to said banknote accumulator and an inlet of said banknote cassette;

said reversible banknote drive path at an outlet of said validator including an angled portion extending forwardly towards said front side of said banknote acceptor and dispenser and joining with a first angled segment of said reversible banknote drive path associated with said banknote accumulator and dispenser immediately adjacent said validator outlet;

said first angled segment joining with a vertically extending offset segment of said reversible drive path on said front side of said banknote acceptor and dispenser;

said offset segment joining with a second angled segment extending away from said front side and leading to said inlet of said banknote cassette; and wherein said banknote accumulator and dispenser has a front face forming one side of said banknote drive path and defining said angled segments and said offset segment.

2. A banknote acceptor and dispenser as claimed in claim 1 wherein said structural frame secures said banknote validator and releasably receives said banknote accumulator and dispenser and said removable banknote cassette with said banknote accumulator and dispenser and said removable banknote cassette being removable rearwardly away from said front side of said banknote acceptor and dispenser.

3. A banknote acceptor and dispenser as claimed in claim 1 wherein said banknote accumulator has a back face aligned with a back face of said removable banknote cassette.

4. A banknote acceptor and dispenser as claimed in claim 3 wherein said banknote accumulator and dispenser is capable of storing at least 20 banknotes.

5. A banknote acceptor and dispenser as claimed in claim 1 wherein said reversible banknote drive path includes drive rollers secured in said structural frame that secures said banknote validator and releasably receives said banknote accumulator and said removable banknote cassette, said banknote accumulator and dispenser including idler rollers in an exterior surface thereof that cooperates with said drive rollers for moving banknotes along said banknote drive path.

6. A banknote acceptor and dispenser as claimed in claim 1 wherein said banknote accumulator and dispenser includes a drive roller at an inlet to said banknote accumulator and dispenser that cooperates with a drive roller provided to an opposite side of said banknote path.

7. A banknote acceptor and dispenser as claimed in claim 6 wherein said cooperating drive rollers are driven at the same speed.

8. A banknote acceptor and dispenser as claimed in claim 1 wherein said banknote accumulator and said banknote cassette are independently rearwardly removable from said banknote acceptor and dispenser.

9. A banknote acceptor and dispenser as claimed in claim 1 wherein said banknote accumulator and dispenser includes an inlet adjacent said second angled transition and said accumulator and dispenser winds accumulated banknotes on an accumulating drum.

10. A banknote acceptor and dispenser comprising:

a banknote validator for receiving and validating banknotes;

a removable banknote accumulator and dispenser located at one side of said validator and adapted to temporarily receive banknotes for dispensing as change for subsequent transactions;

a removable banknote cassette located to a side of said banknote accumulator and dispenser opposite to said validator;

said removable banknote cassette and said removable banknote accumulator and dispenser with said validator being releasably maintained in a structural frame and forming a vertical stacked configuration with said banknote accumulator and dispenser located between said validator and said banknote cassette;

said banknote validator including a banknote slot on a front side of said banknote acceptor and dispenser for receiving banknotes to be validated;

said banknote acceptor and dispenser including a reversible banknote drive path extending through said validator and connecting said banknote slot and an inlet opening to said banknote accumulator and an inlet of said banknote cassette;

said reversible banknote drive path at an outlet of said validator including an angled portion extending forwardly towards said front side of said banknote acceptor and dispenser and joining with a first angled segment of said reversible banknote drive path associated with said banknote accumulator and dispenser immediately adjacent said validator outlet;

said first angled segment joining with a vertically extending offset segment of said reversible drive path on said front side of said banknote acceptor and dispenser;

said offset segment joining with a second angled segment extending away from said front side and leading to said Inlet of said banknote cassette;

wherein said banknote accumulator and dispenser has a front face forming one side of said banknote drive path and defining said angled segments and said offset segment; and wherein said banknote accumulator and dispenser partially defines said reversible banknote drive path including said first and second angled segments on an exterior surface thereof and said exterior surface includes components of a banknote sensing arrangement.

11. A banknote acceptor and dispenser as claimed in claim 10 wherein said components of the banknote sensing arrangement include at least two light prisms at spaced positions along said banknote drive path.

12. A banknote acceptor and dispenser comprising:

a banknote validator for receiving and validating banknotes;

a removable banknote accumulator and dispenser located at one side of said validator and adapted to temporarily receive banknotes for dispensing as change for subsequent transactions;

a removable banknote cassette located to a side of said banknote accumulator and dispenser opposite to said validator;

said removable banknote cassette and said removable banknote accumulator and dispenser with said validator being releasably maintained in a structural frame and forming a vertical stacked configuration with said banknote accumulator and dispenser located between said validator and said banknote cassette;

said banknote validator including a banknote slot on a front side of said banknote acceptor and dispenser for receiving banknotes to be validated;

said banknote acceptor and dispenser including a reversible banknote drive path extending through said validator and connecting said banknote slot and an inlet opening to said banknote accumulator and an inlet of said banknote cassette;

said reversible banknote drive path at an outlet of said validator including an angled portion extending forwardly towards said front side of said banknote acceptor and dispenser and joining with a first angled segment of said reversible banknote drive path associated with said banknote accumulator and dispenser immediately adjacent said validator outlet;

said first angled segment joining with a vertically extending offset segment of said reversible drive path on said front side of said banknote acceptor and dispenser;

said offset segment joining with a second angled segment extending away from said front side and leading to said inlet of said banknote cassette;

wherein said banknote accumulator and dispenser has a front face forming one side of said banknote drive path and defining said angled segments and said offset segment; and said banknote accumulator and dispenser include a gate arrangement associated with said second angled segment for selectively directing a received banknote into said banknote accumulator arid dispenser and for dispensing a banknote from said banknote accumulator and dispenser to said reversible banknote path for discharge through said banknote slot of said banknote validator.

13. A banknote acceptor and dispenser as claimed in claim 12 wherein said gate arrangement is part of and removable with said banknote accumulator and dispenser.

* * * * *